United States Patent [19]

Marshall et al.

[11] 4,170,306

[45] Oct. 9, 1979

[54] CONTROL APPARATUS FOR SORTING PRODUCTS

[75] Inventors: William F. Marshall, San Carlos; Tor Arild, Woodside, both of Calif.

[73] Assignee: Ultra-Sort Corp., Belmont, Calif.

[21] Appl. No.: 745,935

[22] Filed: Nov. 29, 1976

Related U.S. Application Data

[63] Continuation-in-part of Ser. No. 695,478, Jun. 14, 1976, which is a continuation-in-part of Ser. No. 687,949, May 19, 1976, abandoned.

[51] Int. Cl.[2] ..... B07C 5/342

[52] U.S. Cl. ..... 209/549; 209/550; 209/565; 209/577; 209/582; 250/226; 356/51; 356/407

[58] Field of Search ..... 209/74 R, 74 M, 75, 209/111.5, 111.6, 111.7 R, 580, 581, 582, 550, 546, 549, 564, 565, 576, 577; 356/51, 93, 95, 156, 157, 178, 40; 250/226

[56] References Cited

U.S. PATENT DOCUMENTS

| | | | |
|---|---|---|---|
| 3,097,743 | 7/1963 | Scholten et al. | 209/111.5 |
| 3,206,022 | 9/1965 | Roberts et al. | 209/111.6 X |
| 3,382,975 | 5/1968 | Hoover | 209/75 X |
| 3,497,302 | 2/1970 | Tipotsch | 356/93 |
| 3,750,883 | 8/1973 | Irving et al. | 209/111.6 |
| 3,757,943 | 9/1973 | Chae et al. | 209/111.7 R |
| 3,918,815 | 11/1975 | Gadbois | 356/157 |
| 3,930,727 | 1/1976 | Vergato | 250/226 X |
| 3,998,555 | 12/1976 | Babb | 356/178 |
| 4,057,146 | 11/1977 | Castaneda | 209/111.7 R X |

*Primary Examiner*—Joseph J. Rolla
*Attorney, Agent, or Firm*—Limbach, Limbach & Sutton

[57] ABSTRACT

A control apparatus for processing the electrical signals generated by an optical ratiometric color sorting scanner, said apparatus generating signals to cause the rejection of articles which differ in color and/or size from predetermined limits. In the scanner, two electrical signals are generated which are responsive to two different spectral regions or pass bands of the radiant energy reflected by the product being sorted. These signals are superimposed on a slowly varying signal responsive to the standing background light. The control circuitry processes the signals to delete the standing light signal and spurious noise signals and determines if the ratio between the signals is greater than or less than a predetermined value, or alternatively, determines when the ratio between the signals is not within a predetermined acceptable range and generates a delayed reject signal thereafter. Other circuits provide signals to a meter for displaying the present reject rate and particle feed rate. Also generated is a reject signal responsive to small unwanted foreign articles passing through the optical scanner, and an alarm circuit for signaling when the passage for articles is blocked or when the control apparatus fails to reject articles within a specified time interval. Two or more such scanners and control apparatus may be operated in tandem while processing the same type of articles, the control apparatus arranged as master and slaves, with the slave reject criteria servoed to that of the master.

12 Claims, 11 Drawing Figures

CONTROL APPARATUS FOR SORTING PRODUCTS

CROSS-REFERENCE TO RELATED APPLICATIONS

This is a continuation-in-part of U.S. application Ser. No. 695,478, filed June 14, 1976, which is in turn a continuation-in-part of U.S. application Ser. No. 687,949, filed May 19, 1976, now abandoned.

BACKGROUND OF THE INVENTION

In the sorting of articles, such as beans, one method of detecting defective products has been to reflect light from the individual beans and detect the reflected light at two different light wavelengths. Defective beans are usually discolored and differ from normal beans in that they produce a different ratio of reflected light at the two selected wavelengths.

In all such apparatus for sorting articles one important factor is the need to pass each article, such as beans, past the inspection point substantially in single file order. One such satisfactory means is disclosed in the copending application, Ser. No. 687,981, filed May 19, 1976, entitled A FEED WHEEL FOR A SORTING APPARATUS. In this apparatus articles are fed from a central hopper by the use of a revolving wheel assembly which picks the articles from the supply and propels them individually through an optical scanner. Such an optical scanner is described in copending application, Ser. No. 687,950, filed May 19, 1976, entitled LIGHT AND COLOR DETECTING SCANNER FOR SORTING APPARATUS. This detecting scanner comprises the combination of a sealed enclosure penetrated by a transparent sleeve through which the articles to be sorted are propelled individually, illuminating means providing a thin homogenous plane of light extending substantially perpendicular to the path of the articles, a first set of optically filtered photodiodes connected in parallel which are responsive to light of a chosen wavelength and which are arranged uniformly about the glass sleeve both above and below the plane of illumination so as to uniformly detect light reflected from all surfaces of the articles being sorted as they individually pass through the plane of illumination, a second set of optically filtered photodiodes connected in parallel which are responsive to light of a second wavelength and which are uniformly and symmetrically interspersed with the first set of photodiodes so as to also uniformly receive light reflected from all surfaces of the articles being sorted, means to adjust the sensitivity of each set of photodiodes to predetermined levels, means to connect the illuminating means to an externally regulated power supply, and means to connect the outputs of the two sets of photodiodes to a control apparatus.

Previous apparatus for color-sorting applications have suffered greatly because of the great amount of operator skill and technical sophistication required to make the operation profitable. Typical of the steps required to set up previous apparatus are such itmes as determining which color background standard to use with an appropriate filter selection, both selections depending on the hues of colors encountered in the product to be sorted. Once selected these must be installed in the optical head taking care to see that they are clean.

Since the selection of filters is usually a trial and error process this can prove to be a lengthy procedure. Slits must be chosen (if used) based on the size of the product to be sorted. The electronic control system can now be set up after warmup (usually ½ hour if phototubes are used) after which time the phototubes can be standardized, the background selected, evaluated and if acceptable, the system can be adjusted for optimum sorting. Reject selectors, air pressures, delay time for rejectors, duration of reject time and then final adjustments or fine tuning must now be made for optimum sorting accuracy.

Since milling-warehouses and other dry produce sorting establishments where sorting apparatus are used to not generally have access to a labor force with the high degree of technical skill required to have an in-depth understanding of the machine and its adjustments, and since further the interaction between adjustments are such that a person having considerable training with the machine is required, it can be seen that these establishments, which are usually low profit margin operations as well as being seasonal, need apparatus which can be operated by relatively unskilled persons. Further compounding the problem is the requirement that the apparatus usually has to be trimmed on a continuing routine basis after the initial setup to correct for drift stemming from dust buildup and temperature related gain variations. Also, in prior apparatus it is not readily apparent to the operator whether the apparatus is continuing to reject at the levels originally set without diverting the sorted product from the main collection hopper and examining it on a statistical basis. The apparatus is usually stopped during the examination to prevent contamination of the already sorted product, further causing a loss of productive time. As a result of the aforementioned problems, such apparatus often runs at less than top efficiency or sits idle for long periods awaiting repair or adjustment by a technician or a manufacturer's representative.

In several prior art systems a log-anti-log analog divider or pulse width modulating scheme has been used to give the quotient of the ratio of two signal channels. Where a signal is required that is proportional to the ratio, for example, for proportional control of a system, such schemes are necessary. However, if this quotient is compared to a constant to render threshold information, the analog division is unnecessary.

The following description will show how the analog division circuitry of the prior art is circumvented, thus allowing a relatively simple, drift-free electronic control package. It further will be shown how these problems have been circumvented, and that when the invention is used in combination with the invention of the previously identified copending application entitled: LIGHT AND COLOR DETECTING SCANNER FOR SORTING APPARATUS, a highly accurate and stable sorting apparatus is provided. In operation, the only critical adjustments made by the operator are the reject thresholds and adjusting of these thresholds has been simplified by displaying the reject rate information as feedback information to the operator.

It is, therefore, the primary object of this invention to provide an effective and economical control system, requiring minimum operator skill, to process the signals from a scanner such as that of the above-mentioned copending application. The output signal of the control system is a reject signal suitable for driving a solenoid-operated air blast rejection system.

Other features of the control system allow the reject threshold to be adjusted by the operator, that is the operator may adjust for the degree of discoloration that will cause the system to reject a product, such as a bean. There are two thresholds the operator may set, one threshold determines the rejection of beans that are darker than normal hue and the other threshold is for beans that are of a lighter than normal hue. Either or both may be enabled at the same time. In addition, the option of rejecting small foreign articles is provided and this threshold is factory adjusted.

Further included in the control system is a meter that displays the on-going rate of rejection for setting the dark and light thresholds, balancing the rejection rates of several processing channels in a multi-channel sorting apparatus, and indicating that the apparatus is functioning correctly.

Typically in the processing of articles a plurality of sorting devices are run in parallel in order to increase the processing rate. Although separately adjusted sorting devices can be used, such an approach requires further operator involvement, additional set up time and may result in different rejection criteria for each sorting unit. It is therefore desirable to provide a master unit having the various operator adjusted controls and a plurality of slave or tracker units that automatically follow the master sorting criteria. Also, by providing several units that are switchable between master and tracker operation, in the event of failure of a master unit, a tracker unit may be switched over to master operation in order to avoid down time of an entire system.

SUMMARY OF THE INVENTION

In apparatus for sorting articles, signals are generated responsive to light of separate wavelength spectra reflected by the articles as they pass a predetermined position in single file order. The light signals each comprise a pulsed signal generated by the reflected light due to the passage of the product past a detector and a standing signal generated by the background light from sources other than the light reflected from the article. A control apparatus having first and second circuits for receiving the light signals responsive to the different wavelength spectra or pass bands, respectively, deletes the standing light portion of the signal and a first comparator compares the light signals after deletion of the standing light signals to generate a first output signal if the ratio of the two signals is greater than a predetermined value, thereby indicating a ligher than desired hue. A second comparator compares the light signals after deletion of standing light signals to generate a second output signal if the ratio of the two signals is less than a second predetermined value, thereby indicating a darker than desired hue. A third comparator means generates a third output signal if the absolute amplitude of one signal is less than a predetermined amplitude. Means are provided to detect the occurrence of the first, second or third output signals for enabling the sorting apparatus to react in sorting the products. A meter display for the operator reads proportional to the percentage rate of rejection to permit adjustment of the apparatus performance. Also displayed are the product feeding rate, the evenness of feeding and whether the rejector is functioning. A remote alarm device indicates a system malfunction. There is further provided an output signal indication for monitoring the quantity of product processed.

DESCRIPTION OF THE PREFERRED EMBODIMENTS

Figure 1:
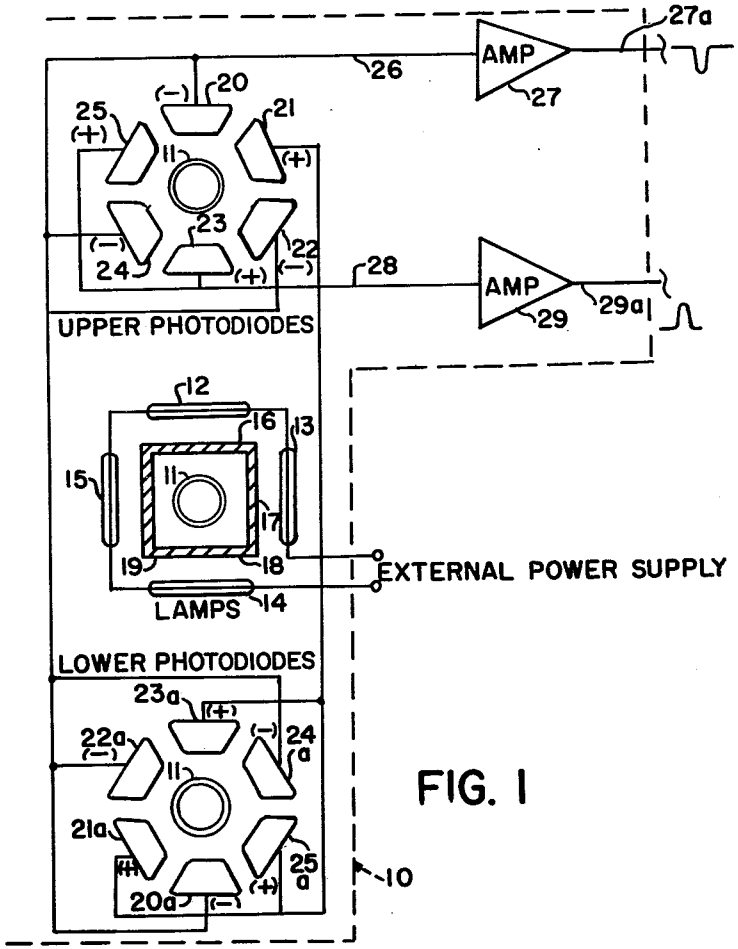
FIG. 1 is a schematic block diagram showing the optical scanner.

With reference to the drawings in detail, in FIG. 1 is shown in schematic form the light detecting scanner 10 through which the articles such as beans are passed for the purpose of detecting the defective ones. The articles are passed in single file order through a tubular sleeve 11 having transparent walls. Positioned around the sleeve are preferably four light sources 12, 13, 14 and 15 in combination with collimating lenses 16, 17, 18 and 19 which illuminate an object as it passes through the sleeve 11. The power source for the light sources can be of standard design and is not shown. Associated with these light sources are detectors 20, 21, 22, 23, 24, 25 and **20*a*, 21*a*, 22*a*, 23*a*, 24*a* and 25*a* which are positioned so as not to receive direct light from the associated lamps but to receive reflected light from the articles passing through the sleeve 11**, together with stray light. A more complete description of the light detecting scanner can be obtained by reference to the above-identified patent application entitled LIGHT AND COLOR DETECTING APPARATUS FOR A SORTING APPARATUS. The two sets of photodiodes are responsive to two different optical wavelength spectra or pass bands preferably, in the visible and infrared portions of the spectrum.

The detectors 20, 22, 24 and **20*a*, 22*a* and 24*a* are connected by the conductor 26 to a signal amplifier 27. The detectors 21, 23, 25 and 21*a*, 23*a* and 25*a* are connected by the conductor 28 to the amplifier 29. The electrical return path is through a ground connection. In this manner the reflected visible signal is fed to a first circuit including the amplifier 27 while the reflected infrared light is fed to a second circuit including the amplifier 29**. These amplifiers may be mounted on circuitboards associated with either the optical scanner or the control module.

With the passage of articles through the optical scanner, two coincident signals are generated by the two groups of photodiodes detecting reflected light at the two different wavelength spectra. These signals appear at the output of the photodiodes as pulses, their duration being roughly the transit time of the article as it passes through the illumination band within the optical scanner.

Because the surface reflectivity of the article being sorted is determined by detecting the ratio of two spectral regions of reflected light, the coloring detecting system is not sensitive to the size of the article being sorted. The amount of light reflected by an object is determined by both the size and selective reflectivity (color) of the object, and when this reflected light is detected either as an absolute quantity or judged against a standard, the reflectivity due to color cannot be discriminated from the reflectivity due to size. By detecting the ratio of two spectral regions of light reflected from the same object under identical viewing conditions, however, only the selective reflectivity or surface color of the object is detected inasmuch as a change in the object's size does not change this ratio. The operation of the optical detector is described in further detail in the above-identified copending application LIGHT AND COLOR DETECTING SCANNER FOR A SORTING APPARATUS.

Figure 2A:
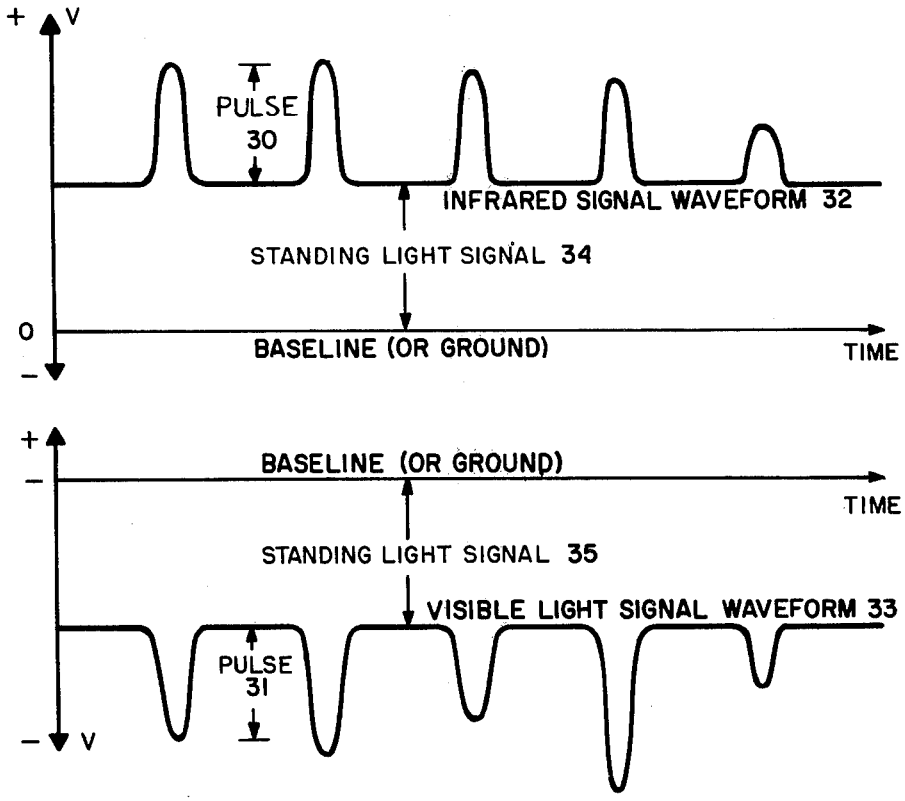
FIGS. 2A and 2B illustrate various waveforms useful in understanding the invention.
Figure 2B:
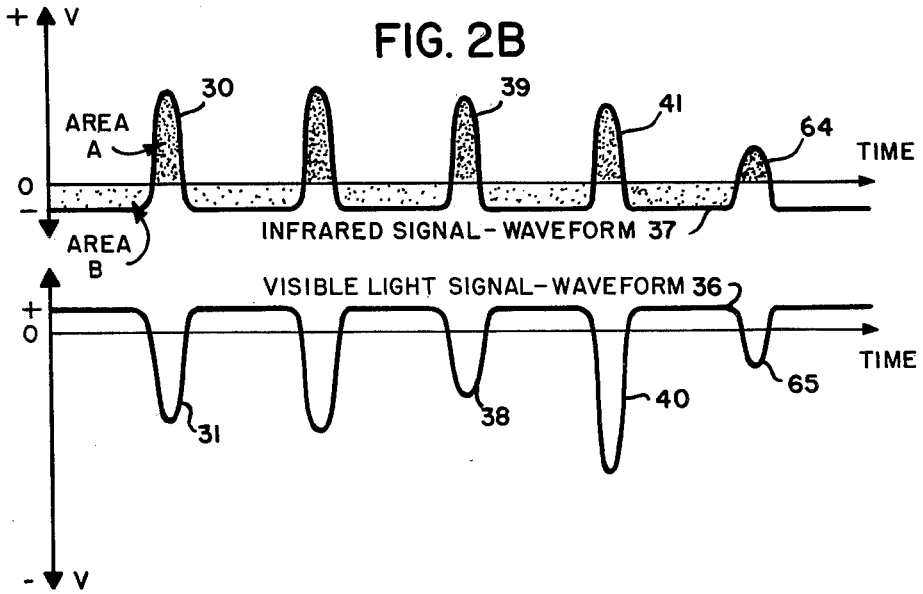

Although the photodiodes do not view any diect light from the light sources within the optical scanner, the inside diameter of the transparent sleeve through which the articles pass becomes unavoidably coated with dust. The dust scatters light from the light source to produce a DC signal, referred to herein as the standing light signal. Over a period of minutes the level of dust buildup will vary slightly producing a slow variation in this DC signal. The pulses produced by the passage of articles through the optical scanner are, therefore, superimposed on a slowly varying standing light signal. In order to make an accurate ratio comparison this standing light signal must be negated. FIG. 2 illustrates the waveform of the signals as they appear at the output of photodiode amplifiers 27 and 29 of FIG. 1. Pulses 30 and 31 of waveforms 32 and 33, respectively are shown superimposed upon the standing light signals 34 and 35, respectively. The photodiodes output signals are connected as previously described directly to the current summing junction of amplifiers 27 and 29 which amplifiers are of the transresistance type. The output signals at **27*a* and 29*a* are voltages proportional to the amount at their inputs, allowing the photodiodes to be operated in their short-circuited current mode, thus providing very good photodiode linearity. Note that signal 31 of waveform 33 is of opposite polarity to signal 30 of waveform 32. This is achieved by connecting the photodiodes generating waveform 32 in the opposite polarity to the photodiodes generating waveform 33**. Its purpose is to simplify the ratiometric determination at the outputs of the two channels described later.

In accordance with another feature of this invention the first and second circuits receiving the visible and infrared light signals include means for effectively deleting the standing light signal. This means is provided in the form of a capacitive coupling comprising the capacitors C1 and C2 in the respective circuits with the associated resistors $R_1$ and $R_2$ (see FIG. 3). By use of this differentiating RC combination the standing yet slowly varying light level is removed and the signals are displaced to the extent that the waveforms appear in the first and second circuits as the waveforms 36 and 37 in FIG. 2B, respectively. The time constant provided by the coupling capacitors C1 and C2 in combination with resistors $R_1$ and $R_2$, respectively, and any input impedance of amplifier 42 and 43, respectively, is long, on the order of about 5 seconds, for example.

Area B in FIG. 2 has been greatly exaggerated for purposes of graphic illustration. The time constant provided by the RC combination is sufficiently long to not appreciably alter the displacement of the level of the base line of the pulses as the pulses randomly vary in amplitude but short enough that the slow variations in the standing light signals are not coupled through to vary the base line. Also, the time constants on the infrared and visible channels are exactly the same, thereby ensuring that the slight drift because of possible variations in pulse heights due to variations in product size cause the base lines to drift in an equal manner. Since the drift is equal on both channels it is essentially nulled out when the ratio is measured.

Because of the capacitive coupling, the area A above the zero voltage line is equal to the area B below the zero voltage line. It will be understood that the differentiating RC action causes the area B displacement to be dependent on the pulse rate and pulse height. Because of the spaced disposition of the pulses with respect to the elongated no-signal areas in between, the pulses are displaced vertically a sufficient amount to provide effective detection of changes in amplitude of the pulses (in the manner to be explained later) to indicate an unwanted article.

For example, the pulse 38 of the waveform 36 with the corresponding pulse 39 of the waveform 37 is shown to illustrate an article which is of a darker color hue than the normal, which could be due to some defective characteristic on the surface in the case in which beans are being sorted. As can be seen, the ratio of the amplitudes of these signals is sufficiently different from the normal pulse ratio for a standard bean as indicated by the previous pulses that it can be detected even though the pulse is offset slightly relative to the zero voltage signal by the area B on the opposite side of the zero abscissa from the pulse signal.

Similarly, the pulses 40 and 41 of the waveforms 36 and 37, respectively, are included to indicate a bean which is of a lighter color hue than normal probably due to the fact that, for example, in the case of coffee beans, the bean is not ripe. These pulses are also of sufficient ratio difference from the other pulses generated by normal beans to be detectable even though there is some offset due to the area below the zero abscissa line.

Thus, the signals 36 and 37 are fed to the high impedance buffer amplifiers 42 and 43 respectively, and from there through adjustable low pass filters 44 and 45, respectively in the first and second circuits, for deleting or filtering out noise spikes and, if desired, partially integrating the signal from each individual bean as it is scanned by the light band. By narrowing the bandwidth of the low pass filter, the signal outputs from the scanner can be electronically time-averaged so that the reflected light or color information from each individual article is accumulated as the article passes through the narrow field of illumination. In this manner the band of illumination is effectively widened electronically and a ratio may be formed which depends only on the average or overall color characteristics of the particular article being inspected. By widening the filter bandwidth, the non-averaged or instantaneous localized signal outputs from the scanner are available to be processed for spot detection. Thus, the system may be used as a spot detector or as an average color detector of each article (as in the sorting of certain types of multicoloed seedbeans such as Scarlet Runners which are entirely spotted).

In accordance with another feature of the subject invention and for the purpose of determining the quality of the articles to be sorted, the two pulse signals 36 and 37 for each article are compared to determine if the ratio between them is greater than or less than a preset value. Those articles that fall inside the window of the preset values are passed through to a collection point for acceptable articles and those articles falling outside those values are diverted to a collection point for rejected articles. This determination is implemented by the use of a combination of two potentiometers and two comparators. One potentiometer 46 and its associated comparator 48 will cause to be rejected articles having a ratio value greater than a present value indicating that the product has a lighter than desired hue. The other potentiometer 47 and the comparator 49 will affect the rejection of articles having a ratio value less than a preset value, indicating that the hue is darker than desired. Since the signal levels 50 and 51 are restored to a ground reference with the standing light signals subtracted out and since the threshold ratio is preset, analog division of the two signals to determine the ratio is not necessary.

Figure 3:
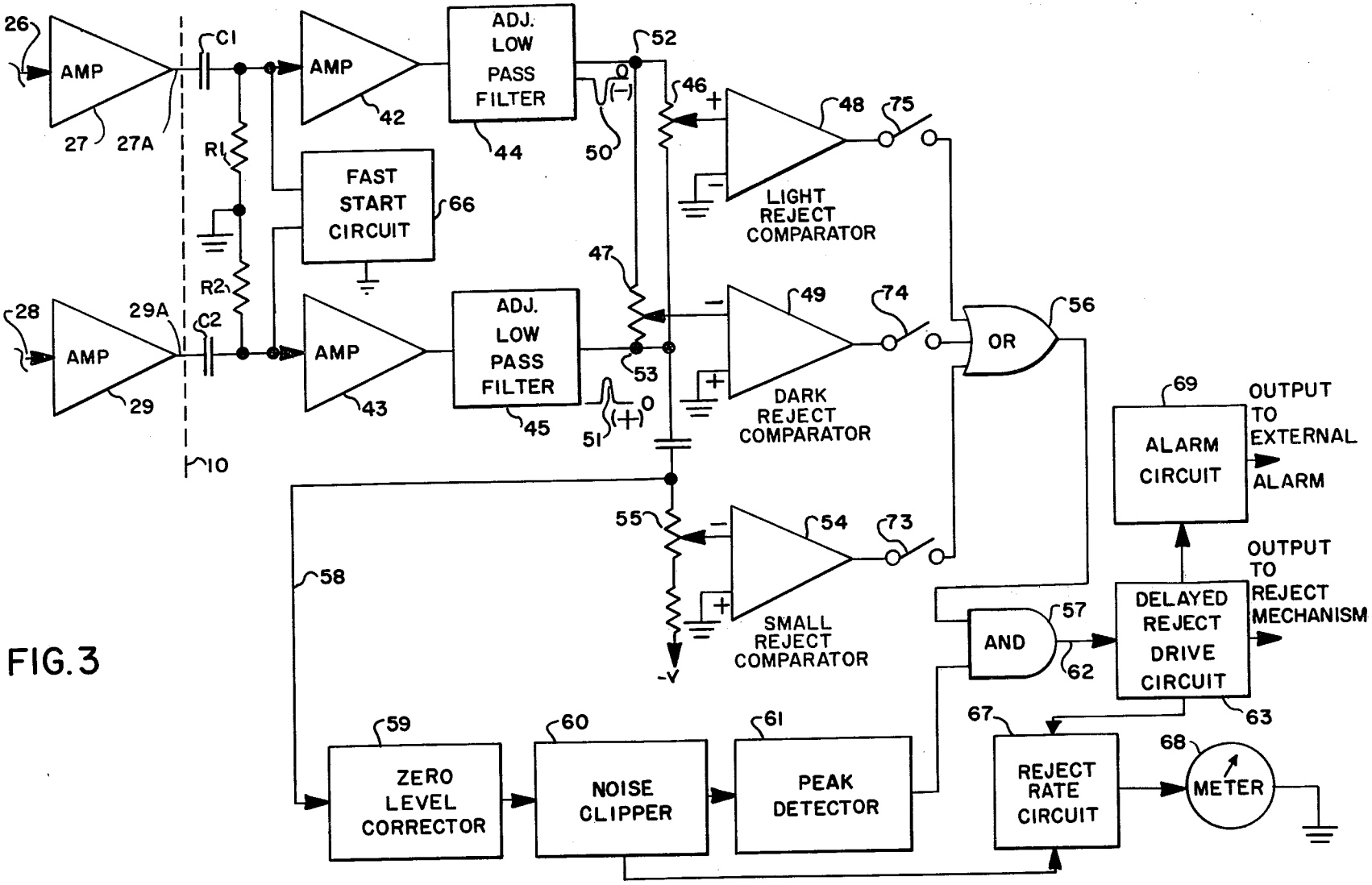
FIG. 3 is a block diagram of the circuitry of the invention.

As shown in FIG. 3, the arms of the potentiometers 46 and 47 are connected to the output of the two signal channels at 52 and 53. The wipers of the potentiometers are voltage summing points connected to the input of operational amplifier comparators 48 and 49, respectively, while the comparator reference inputs are connected to ground. The threshold ratio is the point at which the resistance of the arms of the potentiometer is proportional to the amplitude of the associated negative pulse 50 and the positive pulse 51. At this threshold the wiper on the potentiometer remains at ground potential regardless of the amplitude of the pulses so long as the ratio between the pulses stays the same.

It can be seen that if the ratio between the pulse amplitudes changes in that the absolute value of the pulse amplitude 50 becomes larger than pulse 51, the wipers on potentiometers 46 and 47 go negative. Similarly, when the pulse amplitude 51 becomes ratiowise larger than pulse 50 the wipers will go positive. The comparators sense whether the potentiometer wiper signals are positive or negative with respect to ground. The amplifier 48 responds to signals more positive than ground, indicating an article is "too light" and the amplifier 49 responds to signals more negative than ground, thereby indicating that the article is "too dark".

Thus, it is clear that the invention for the high speed sorting of articles does not concern itself with the numerical value of the ratio but rather whether or not the ratio is greater than or less than a preset value. It can further be seen that the operator may adjust the preset ratio value to any level of rejection and, therefore, has infinite control over the percentage to be rejected and also that the operator may choose to reject either "too light" or "too dark", as well as both at the same time, with minimum time required for setup.

The third operational amplifier comparator 54, described further below, determines simply whether the absolute value of the amplitude of the infrared signal is less than a predetermined value set by potentiometer 55, causing articles "too small" in size to be rejected. If an output occurs from either comparator 48, 49 or 54 or all of them, there appears a signal at the OR gate 56 output. This signal is applied to one input of the AND gate 57.

Switches 73, 74 and 75 permit any combination of the comparators 48, 49 and 54 to control the reject circuitry.

For timing the reject signal, the pulse from the infrared channel is supplied through the conductor 58 and via the signal conditioning elements 59 and 60, applied to the peak detector 61. The peak detector specifies the instant in time that the peak of the pulse occurs by generating a short logic pulse corresponding in time to the peak of the infrared channel pulse. This logic pulse is applied to the other input of the AND gate 57. The presence of a signal on the two inputs of the AND gate 57 produces the reject signal at 62 and thus only allows reject information from the comparators to be considered a reject signal if the comparators are giving this information on the peak of the pulse produced by the product flowing through the optical head. The reject signal is fed through the conductor 62 to the delayed reject drive circuit 63 for sorting out those unwanted articles as determined by the ratios present by adjustment at the potentiometers 46 and 47.

In this same circuit may be supplied the zero restoring circuit 59 which serves to set the base line of the AC coupled signal to ground potential for the purpose of satisfying a noise rejection requirement for the peak detector. There may also be the noise clipper circuit 60 which prevents signals smaller than a predetermined value which value is always smaller than the value of the "too small" setting, from reaching the peak detector, thereby further insuring that spurious signals do not activate the peak detector.

There may also be supplied a third comparator 54 whose function is to supply a signal to the OR gate 56 whenever the peak value of the infrared signal is less than a predetermined level as determined by the setting of potentiometer 55. The purpose of this feature is to initiate a reject signal whenever an object passes through the scanner 10 having an infrared reflectivity, due to its small size, considerably less than that obtained from particles of the product being sorted. For instance, the pulse 64 of the waveform 37 (FIG. 2B) is shown to illustrate an article (typically a small stone) whose infrared reflectance is substantially lower than that typical of the sorted product. The rejection of this article may be initiated by comparator 54 regardless of the ratio of peak 65 to peak 64 of the waveform 36. This circuit does not select size in a precise manner, however, because of the previously mentioned inability of a single channel to discern between size and reflectivity of the product being sorted.

In addition, there is supplied the fast starting circuit 66 connected between the first and second circuits after the capacitor coupling network. This is a switching circuit which upon the application of power to the circuitry as it is turned on, connects the junctures of the capacitor $C_1$ and the resistor $R_1$ and the capacitor $C_2$ and the resistor $R_2$ to ground for the purpose of initializing the capacitors while the signal representing the standing light level rises and reaches a steady state. This enables the circuit to make accurate ratiometric determinations immediately as the machine is started rather than running in error until the RC circuitry has reached a steady state condition.

To facilitate setting up the ratio threshold and as a check that the system is functioning correctly, a reject rate circuit 67 is provided which drives a meter movement 68 to display the reject rate on a relative scale. The reject rate circuit measures the rate at which reject signals occur as compared to the rate at which articles are being fed through the scanner so as to produce a voltage which is proportional to the percent of articles being rejected and which is not affected by variations in the rate at which articles are being sorted. The first input to this circuit is the output of the reject driver. Because the pulses from the reject driver are of uniform amplitude and duration, a simple RC filter is all that is needed to produce a voltage on a capacitor which is proportional to the frequency of the reject pulses. The second input to the circuit are the pulses that are generated within the noise clipper circuit 60 for the purpose of conducting bean pulses to the peak detector while blocking any noise that might occur between bean pulses. The noise clipper control pulses are of uniform amplitude and duration and which occur at the rate of one for each article being scanned. These pulses are used to control the duty cycle of a semiconductor switch and discharging resistor network connected in parallel with the charging capacitor of the reject rate circuit. Thus, the capacitor charges at a rate controlled by the rate of reject pulses and discharges at a rate controlled by the rate of product feed so that the capacitor voltage varies only as the percentage rate of reject varies.

The alarm circuit 69 is effectively a timer that is reset every time a reject pulse occurs. If no pulse occurs to reset the timer for an extended period of time, time runs out on the timer which activates a switch closure that will drive an alarm system. The normal time period of the resettable timer is set such that the statistical probability of having no rejects for the set period of time is extremely remote. Preferably the time period is not adjustable by the operator.

Figure 4:
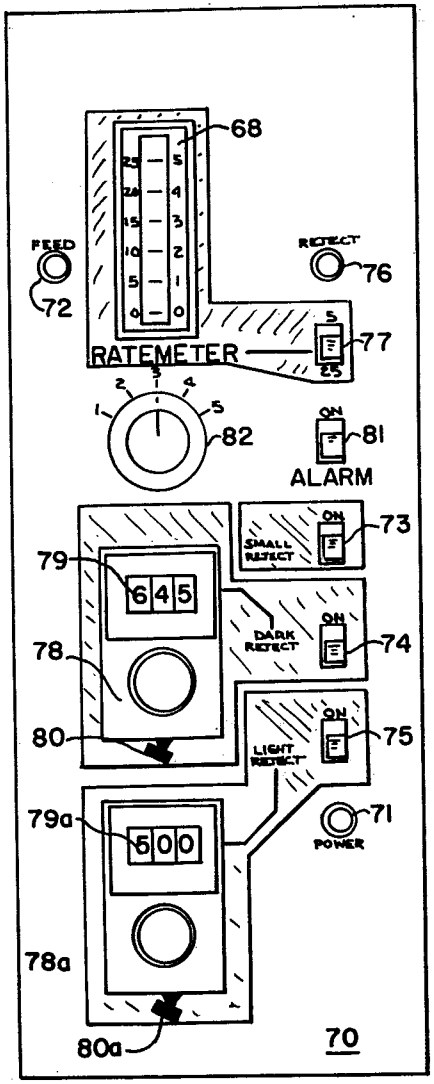
FIG. 4 is an illustration of the control panel for the invention showing the threshold adjustment and operator feedback information displayed.

FIG. 4 is an illustration showing the front panel 70 with controls and operator feedback information displayed. The "POWER ON" indicator 71 is an LED connected in such a manner as to indicate to the operator that both the plus and minus power buses are active. The Feed-rate display 72 is an LED that flashes each time an article passes through the scanner, thereby displaying for the operator's benefit whether the rate of feed is satisfactory and also whether a blockage in the feed channel has occurred. Switches 73, 74 and 75 activate the comparator 54, 49 and 48 outputs, respectively, (see FIG. 3), which in turn will flash an LED 76 whenever reject signal occurs. Meter movement 68 displays rate of reject on a relative scale which can be changed by selecting the appropriate position on switch 77. The dial indicators 78 and **78*a* serve to allow for fine adjustment of potentiometers 47 and 46, respectively, (see FIG. 3) where a numerical readout 79 and 79*a* allows the operator to record the amount of adjustment he has made. When the proper setting has been obtained the indicator may be secured by lock 80. The switch 81 activates the alarm circuit 69 and the knob 82 is for the adjustment of the low pass filters 44 and 45** as well as variable gain settings, if desired.

In a practical application, typically several channels of sorting are carried on simultaneously in parallel sorting apparatus arranged side-by-side and sorting the same type of product. To simplify the operation of such an arrangement, it is desirable to use one of the channels as a master and to slave the remaining channels to it. That is, instead of providing time-consuming individual threshold adjustments for each channel, a servo control arrangement automatically sets the thresholds of the slave channels to that of the master channel.

Figure 5:
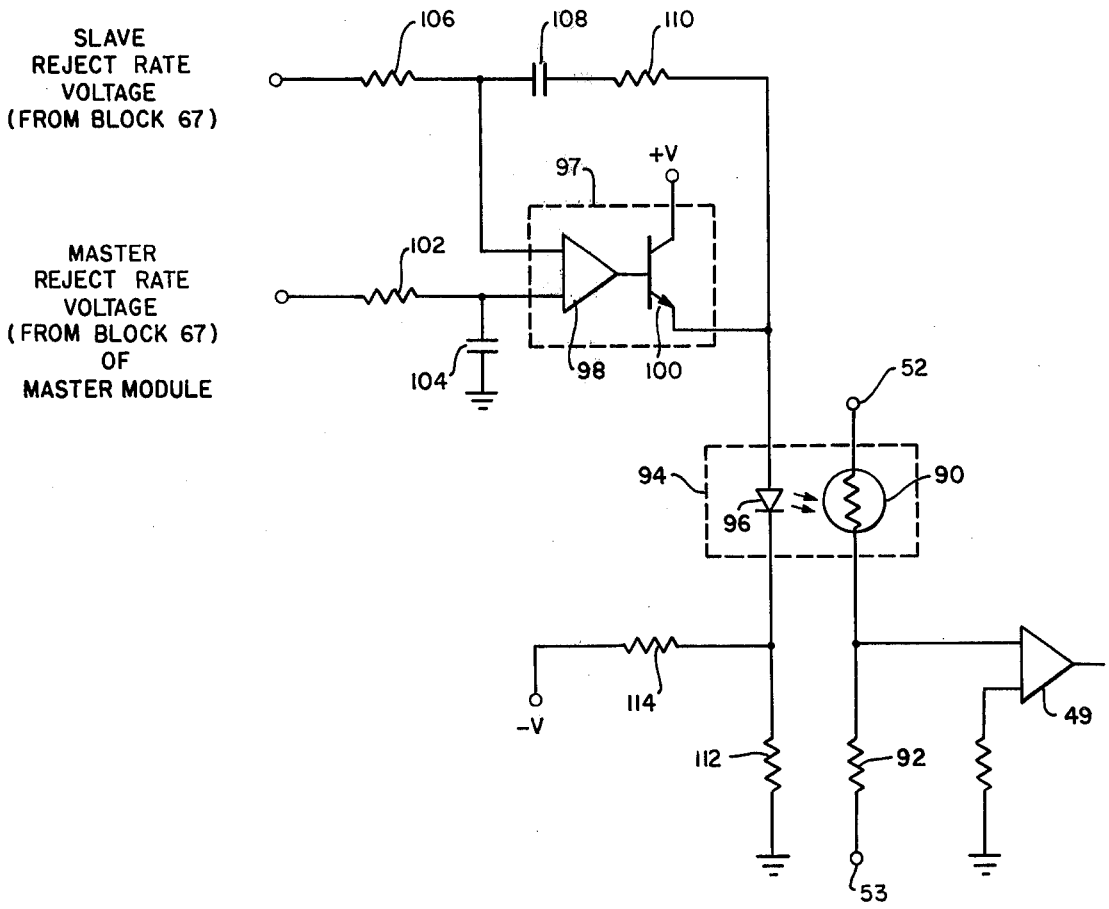
FIG. 5 is a partially block schematic diagram showing the modification of a portion of the circuitry of FIG. 3.

FIG. 5 shows a modification of the circuitry of FIG. 3, indicating the manner in which the dark reject comparator input is slaved to a master channel. The FIG. 3 circuit is modified by removing potentiometer 47. In place thereof, a photoresistor 90 and fixed resistor 92 are connected between junctions 52 and 53. The input to comparator 49 is taken from the junction of devices 90 and 92. Photoresistor 90 is preferably in a light sealed housing 94 containing a light emitting diode 96. Such a housing 94 containing devices 90 and 96 is the type VTL2C2 "Vactrol" manufactured by Vactec, Inc. Although any type of photoresistor and LED would be suitable, the use of a sealed type device eliminates interference from ambient light and greatly simplifies construction.

An integrator type differential error amplifier 97 comprising operational amplifier 98 and PNP transistor emitter follower 100 drive the LEd 96. The master reject rate voltage from block 67 (FIG. 3) of the master channel sorting control circuit is applied at integrating RC input resistor 102 and capacitor 104 to one input of op amp. 98. The slave reject rate voltage from block 67 of the same circuit in which this modification is employed is applied at the RC integrating input resistor 106 to the other input of op amp. 98. Integrating capacitor 108 and a further resistor 110 are connected between that op amp. input and the emitter of transistor 100. The transistor collector is connected to the positive supply voltage. The anode of LED 96 is connected to ground through resistor 112 and to the negative supply voltage through resistor 114.

The integrator type amplifier stage 97 detects any difference between the averaged master channel reject rate and the averaged slave channel reject rate and produces a servo-control voltage to the LED 96.

In operation, the output from the error-amplifier 97 is applied to the LED 96, thereby controlling its radiant output. The radiant output of the LED 96 in turn controls the resistance of the photoresistor 90. In this manner, the series network of the photoresistor and the fixed resistor becomes a variable voltage divider controlled by the relative reject rates of the master and slave channel: in effect a voltage-controlled potentiometer in place of the manually-controlled potentiometer 47. Whenever an average difference exists between the master and slave channel reject rates, the error amplifier 97 drives the voltage divider 90, 92 in the proper direction to minimize the reject rate difference. Because the error amplifier is a high-gain device, the reject rate of the slave channel is automatically and continuously matched to that of the master channel with negligible error.

One master channel may control any reasonable number of slave channels in this manner. To set a machine in operation or to make an adjustment to the machine reject rate, the operator need only adjust the master channel.

In a similar manner, the light reject comparator 48 (FIG. 3) and the size reject comparator 54 may also be slaved to a master channel.

By providing one master control module and a plurality of companion slave modules, the front panel, controls and indicators on the slave modules can be eliminated. Such a master and slave system not only greatly simplifies the operation of a sorting machine but also renders the machine more economical to manufacture because the control servo electronic components are less expensive than the hardware items and meters which they replace.

Thus, it can be seen that there has been provided a control which when used in combination with the previously identified optical scanner provides the user with a simple effective and economical apparatus for sorting articles such as beans, said apparatus being operable with minimum skill requirements on the part of the operator and since both the aforementioned optical scanner as well as the control are of modular form, loss of productive time due to service or failure is minimal since such replacement consists only of removing one module and inserting another, selecting the proper mode switch and adjusting the dial to match the ratemeter reading of other operating modules if the manual operation is used. When using master/slave system if a slave module fails no adjustments are necessary, but if the master module fails the previous steps of selecting proper mode and adjusting dial to the previous setting are required.

A modified embodiment of the system of FIGS. 1–5 is shown in FIGS. 6–10. In this further embodiment, a master-slave system is provided in which the sorting functions are automated to a greater extent. Multiple units switchable between master and slave mode are provided for redundancy in the event of failure by providing units that are readily switched between master and slave (tracker) operation. Slave (tracker) modules servo their reject rates to that of the master unit. Alarm circuitry is modified to provide additional functions and improved operation.

Figure 6:
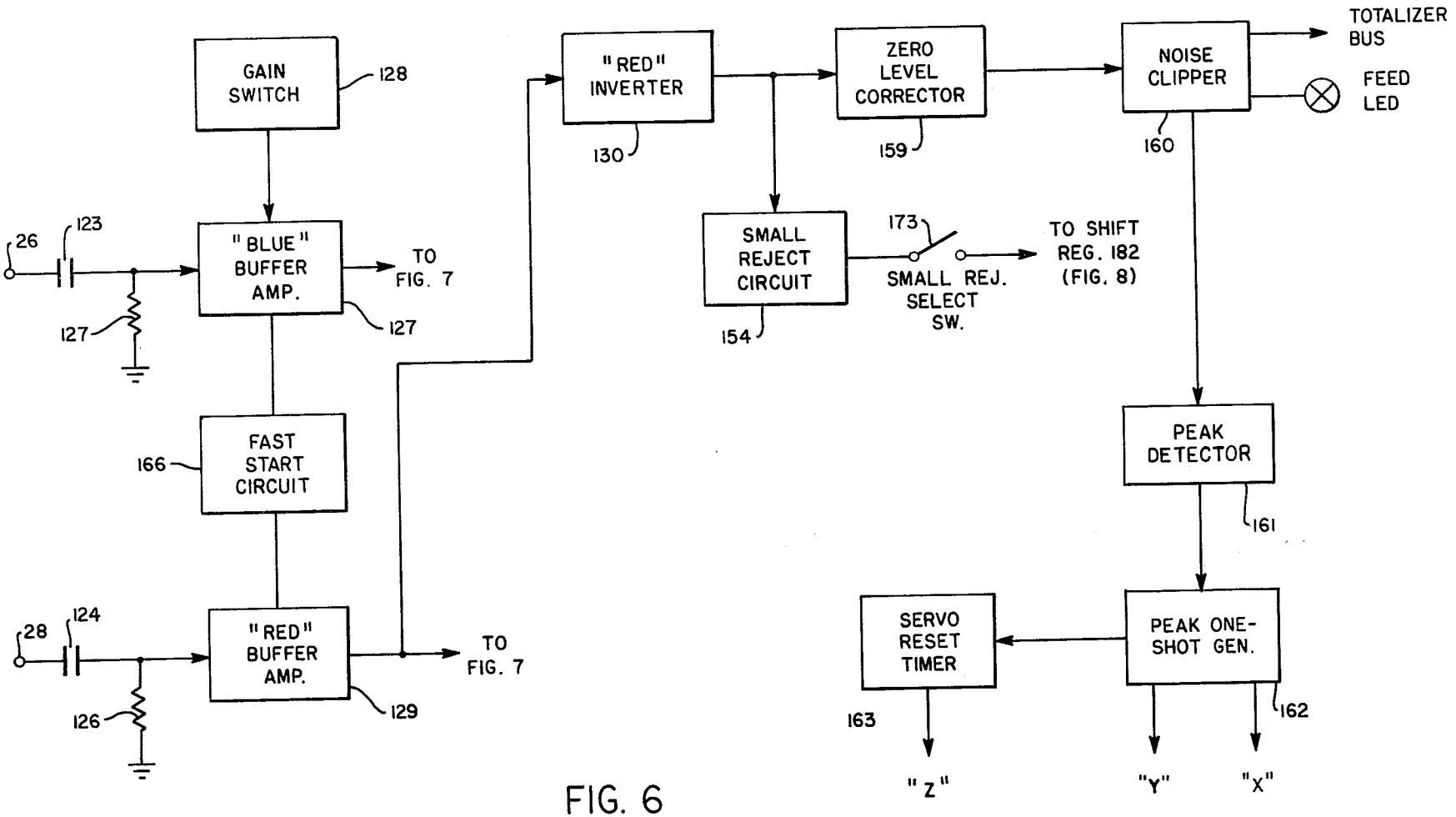
FIGS. 6–8 are block diagrams showing a modified embodiment of the circuitry of FIGS. 3 and 5.
Figure 7:
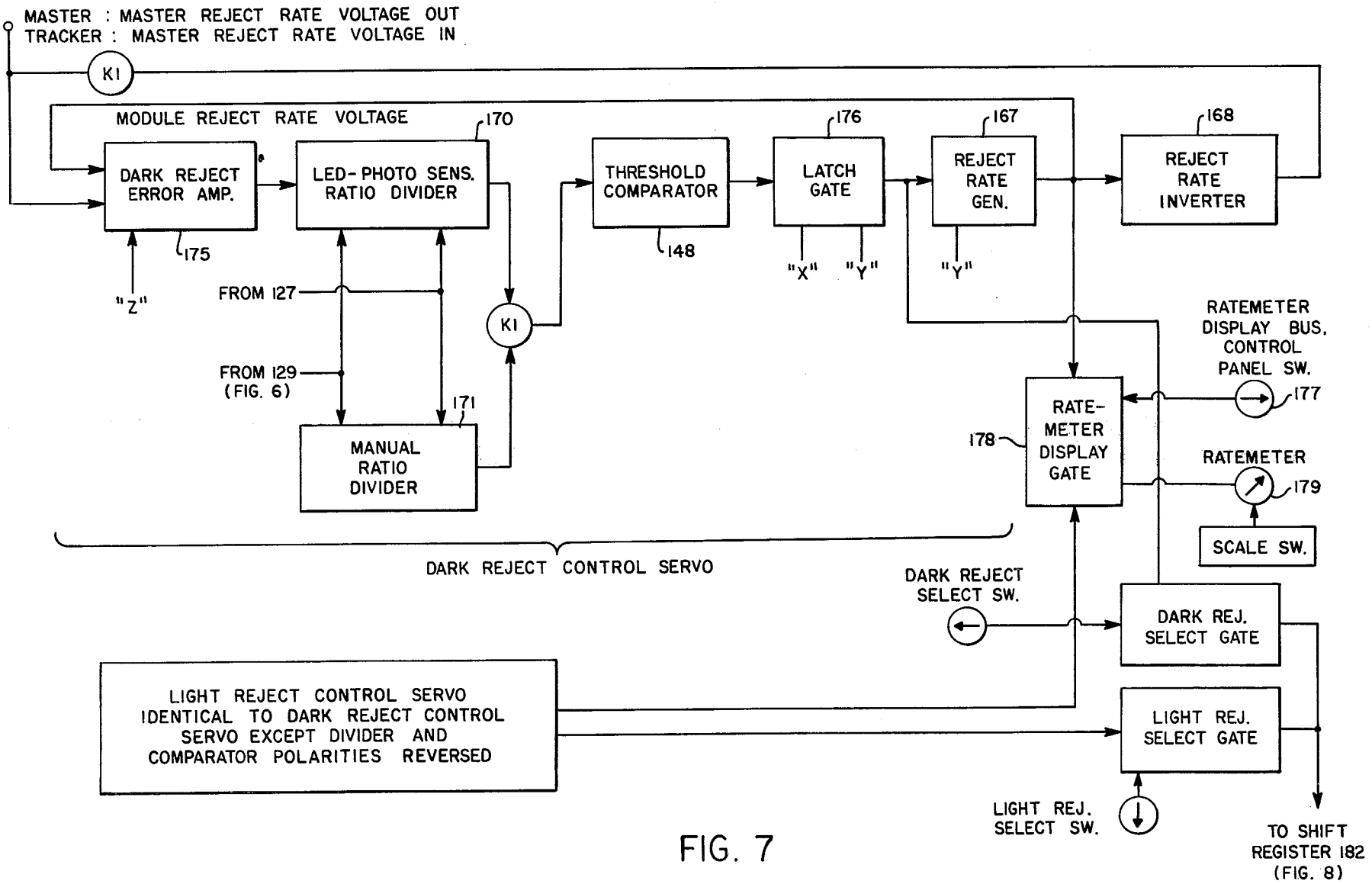
Figure 8:
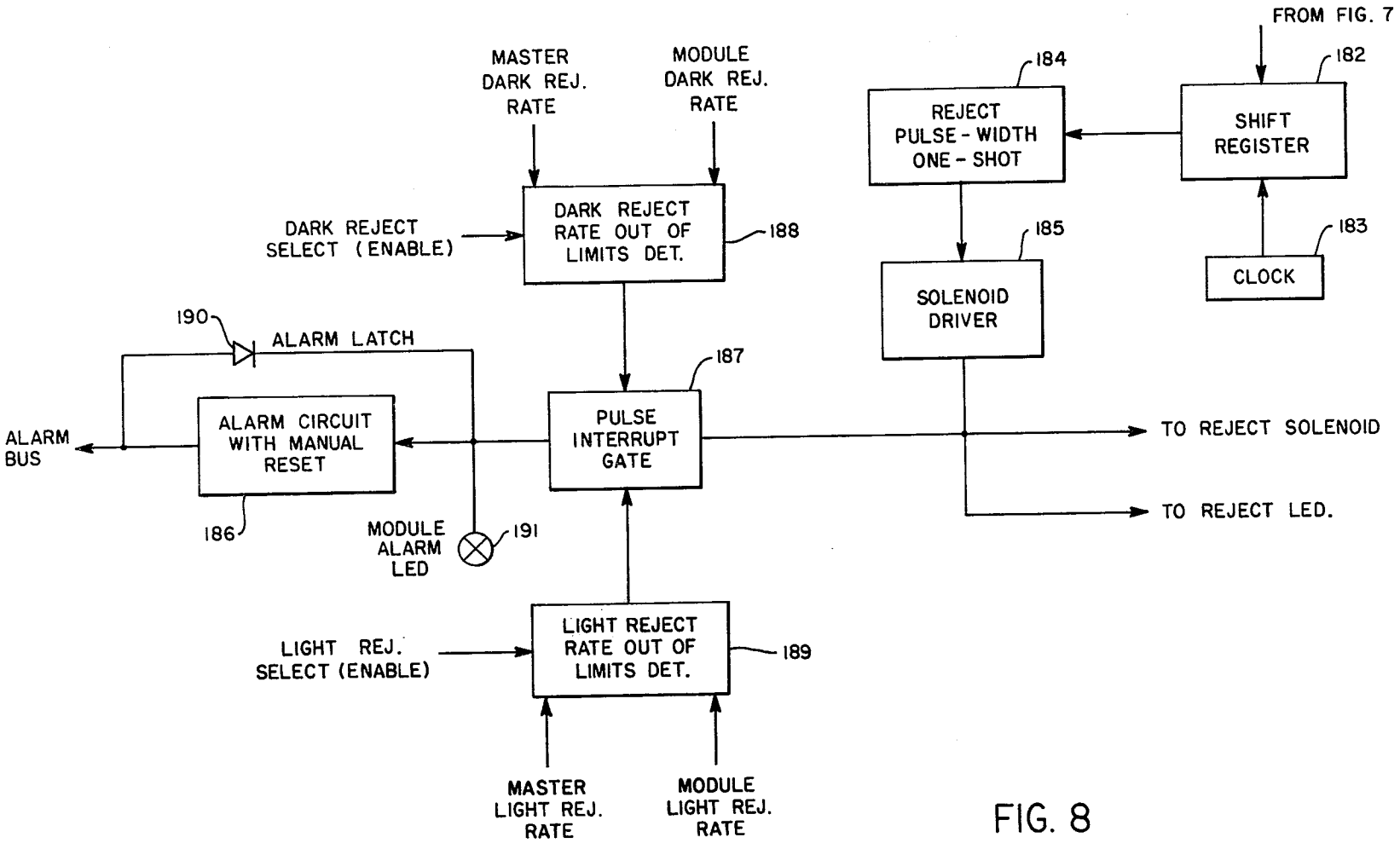

Referring now to FIGS. 6–8, wherein block diagrams of the circuitry of a module according to the invention are shown, the inputs 26 and 28, reflected visible and reflected infrared energy as in FIGS. 1 and 3, are applied to buffer amplifiers 127 and 129, respectively. These buffer amplifiers function as do amplifiers 27 and 29 of FIG. 3, but are inverting amplifiers rather than non-inverting. In addition, amplifier 127 has a gain switch 128 (which may be located on the module front panel) for high or low gain (10 or 4, for example) tp permit the measurement of very dark particles. Amplifier 129 has a fixed gain (4, for example). The fast start up circuit 166 is the same as circuit 66 of FIG. 3. Amplifiers 127 and 129 each includes low pass filtering to effectively integrate the signals so that average color information is present at the peak times of the buffer amplifier outputs.

A red inverter 130 follows buffer amplifier 129 to restore the polarity convention of the circuit of FIG. 3 with respect to the peak detecting timing and small reject circuits. Differentiating capacitors 123, 124 and resistors 125, 126 in the inputs of amplifiers 128 and 129 function as C1, C2 and R1 and R2 of FIG. 3 with respect to the standing light signals.

The output of inverter 130 is applied to small reject circuit 154, followed by switch 173, which are the same as the small reject circuit elements of the FIG. 3 circuit. A zero level corrector 159, noise clipper 160 and peak detector 161, all corresponding to blocks 59, 60 and 61 of FIG. 3, also receive the output of inverter 130. The noise clipper output also drives an LED, which may be panel mounted, for flashing at the feed rate and drives a totalizer bus (not shown) for counting the product under measurement.

The peak detector 161 output is a square pulse of about 0.2 msec (an "x" pulse) whose leading edge corresponds to the peak of the generally bell-shaped applied pulse. The square wave pulse drives a one shot generator 162 which provides a longer pulse ("y" pulse) output of about 1 msec. Circuits described below receive the "x" and "y" signals. Also, servo reset timer 163 receives the "y" signal to provide a "Z" signal to clamp the light and dark reject error amplifiers (described below) in order to disable a slave module when there is no feed to that module for a given period of time, for example, one minute. Timer 163 is a conventional RC integrating circuit between the collector-emitter of a transistor whose base is driven by the "y" signal.

The "red" buffer amplifier 129, which has its input peaking in the infrared portion of the spectrum, and the "blue" buffer amplifier 127, which has its input peaking in roughly the center of the visual spectrum, have their respective outputs applied to an LED-photo-resistor divider 170 (as in FIG. 5) and to a manual ratio divider 171 (as in FIG. 3) of the dark reject circuit portion. A relay K1 selects divider 170 for slave operation of the module or divider 171 for master operation.

The photoresistor portion 170 of the two dividers (170 and 171) is controlled by the servo error amplifier 175 that receives the master channel reject rate voltage and its own reject rate voltage to provide the reject error voltage. Amplifier 175 functions only when the module is a slave. When the module is a master, the error amplifier 171 receives a clamping "Z" signal by operation of further functions of the master/slave select relay K1.

The output of ratio dividers 170 or 171 is applied to a threshold comparator 148 as comparator 48 in FIG. 3.

A latch generator 176 comprising logic to generate a standard width pulse in response to reject indications receives the comparator 148 output along with the "x" and "y" signals.

Rate generator circuit 167, as block 67 in FIG. 3, generates a voltage to drive the panel display rate meters. The voltage is also fed back to the input of error amplifier 175. An inverter 168 inverts the signal for application of further contacts on relay K1 when the module is a master, the signal from inverter 168 is the master reject rate output. Since the master reject rate signal is of opposite polarity to the slave reject rate, the two signals are easily summed at a junction for input to the error amplifier 175.

The light reject circuit portion is identical to the just described dark reject circuit portion with the exception that the divider 170, 171 and comparator 148 polarities are reversed.

The ratemeter drive signals may be gated by a control panel switch 177 and a ratemeter display gate 178 so that a single panel rate meter 179 can display either the dark or light reject rates.

The outputs from latch 176 of the dark reject circuit and the corresponding latch (not shown) in the light reject circuit drive respective select gates which are enabled by buses connected to panel switches 180 and 181. Thus, switches 180 and 181, along with small reject select switch determine which combination of the three criteria (light, dark, small) will cause rejection of a product.

The selected reject circuit outputs are applied to a rejection delayed circuit (as block 63 of FIG. 3) comprising a shift register 182 driven by clock 183 for time delaying the signals to account for passage of the product from the light detecting region to the rejection region of the machine. The delayed signal drives a one shot 184 which provides an optimum width signal for the solenoid driver 185 which drives a reject solenoid (not shown) for controlling, for example, a compressed air deflector to divert the product into a reject path. The driver 185 also drives a reject LED (not shown) which may be mounted on the module front panel for visually observing the reject rate.

The reject signal is also applied to an alarm circuit 186 through a pulse interrupt gate 187 so that the alarm is set only when certain conditions are not present in the case where the module is used as a slave. The interrupt gate 187 is enabled when the dark reject rate is out of limits, as determined by detector 188 and when the lighh reject rate is out of limits, as determined by detector 189.

Detector 188 is enabled by the dark reject switch 180 and it receives both its own and the master dark reject rate signals. If the difference between the rates is within a predetermined percentage, the gate 187 is not interrupted. Detector 189 functions in the same manner as to the light reject rate.

Alarm circuit 186 is actuated when it receives no reject pulses for a period of time. This can occur under three conditions: (1) no reject pulses from driver 185; (2) detector 188 interrupts the pulses because the slave module dark reject rate is too much greater than the master rate; (3) same as (2) for light reject. Once the alarm is set it is latched by a diode 190 that sets interrupt gate 187. The alarm circuit 186 can then be reset only manually. The alarm output drives an LED 191 which may be located on the module front panel and an alarm bus which can trigger any desired response (audible alarm, for example).

A master/tracker mode switch 192, located on the module front panel, for example controls the K1 relay placing it in either the master or tracker mode. An LED 194, which may be located on the module panel indicates that the relay is in the master mode and thereby provides an indication that the relay is functioning.

In the case where a module is dedicated as a tracker module, rather than having the dual mode switching capability, the switch 192, relay driver 193 and relay K1 may be omitted and the relay pads are jumper wired for tracker mode operation.

Figure 9:
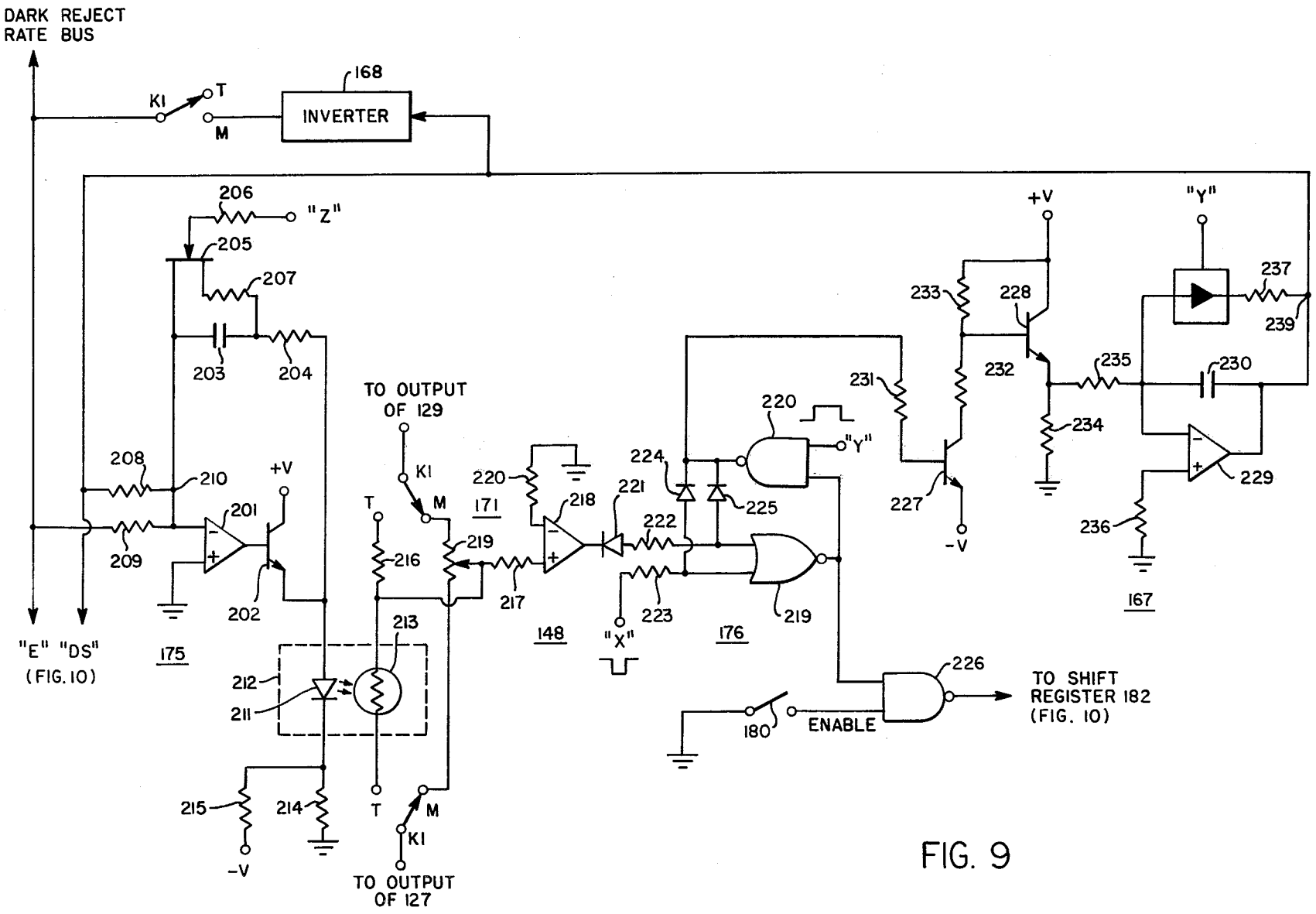
FIGS. 9 and 10 are partially block, schematic circuit diagrams, showing details of the circuits of FIGS. 7 and 8.
Figure 10:
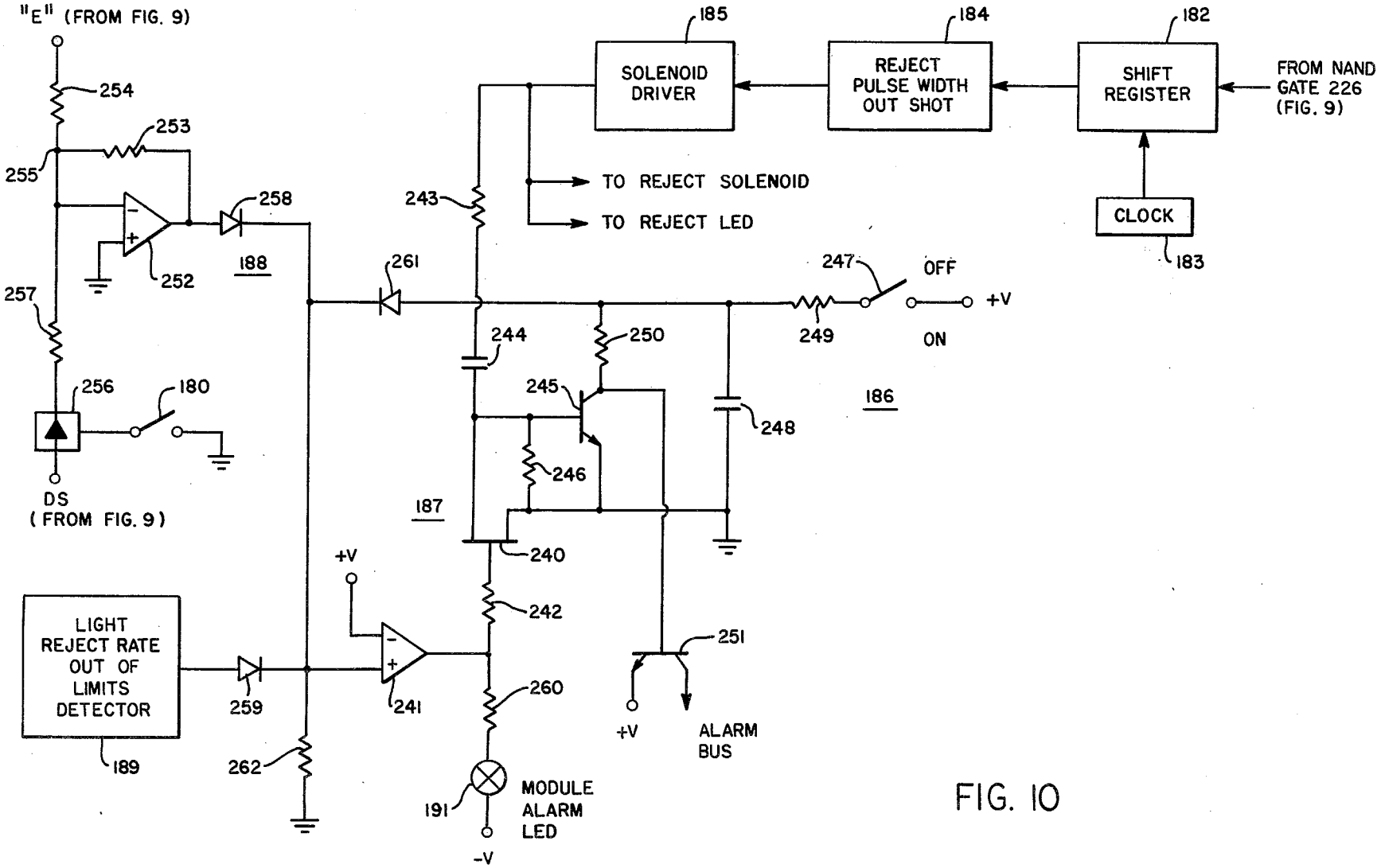

FIGS. 9 and 10 show further details of FIGS. 7 and 8, respectively.

Referring to FIG. 9, wherein the dark reject control servo is shown, it being understood that the light reject control servo is identical except for divider and comparator polarities. The dark reject error amplifier includes an operational amplifier 201 followed by a transistor 202 acting as emitter follower for current gain to drive the following stage. A stabilizing capacitor 203 in series with damping resistor 204 is connected between the emitter follower output and the input of amplifier 201. Capacitor 203 averages the instantaneous error voltage at the amplifier 175 output to provide for a stable operating point. Resistor 204 adjusts the damping of amplifier 175 to provide rapid tracking without overshoot. An FET switch controlled by the "Z" input through a resistor 206 can short capacitor 203 through discharging resistor 207 in order to clamp the output of amplifier 175 near ground potential. This occurs when the module is operating as a master and the error amplifier 173 is not required or when the module is operating as a tracker and product feed has been interrupted. In the absence of such clamping the amplifier would drive into saturation and would be inoperative for several minutes after resumption of normal inputs.

In the tracker or slave mode, the fed back reject rate voltage from reject rate generator 167 and the reject rate voltage from the master module via the dark reject rate bus are applied via resistors 208 and 209, respectively, to a summing junction 210 at the input of amplifier 175. These "E" and "DS" signals, respectively, are further applied to the dark reject rate out of limits detector 188 (FIG. 9). In the master mode, the relay K1 takes the inverted output from rejection rate generator 167 and applies it to the dark reject rate bus to control tracker modules connected thereto (not shown).

The output of emitter follower 202 drives an LED 211 located in a housing 212. A photoresistor 213 varies in resistance in accordance with the output of LED 211. Housing 212, the LED 211 and photoresistor 213 are the same devices as elements 94, 96 and 90 described in connection with FIG. 5. The anode of LED 211 is connected to ground through resistor 214 and to the negative supply voltage through resistor 215. Fixed resistor 216 is connected to one end of photoresistor 213 and their junction is connected through input resistor 217 to operational amplifier 218 of the threshold comparator 148. In the tracker mode, the relay K1 connects the outputs of blue buffer 127 and red buffer 129 to the far ends of resistors 213 and 216, respectively, thus providing a voltage controlled potentiometer as in the FIG. 5 circuit.

In the master mode, relay K1 connects the buffer 127 and 129 outputs to the ends of a potentiometer 219 which is manually adjusted to provide the master dark rejection rate.

Thus the comparator amplifier 218 receives a manually selected ratio of the buffer outputs in the master mode or a servo controlled ratio in the tracker mode. That is, the voltage division, and hence ratiometric color information, presented to the comparator 148 is electronically controlled to force the reject rate response of each tracker to match that of the master. The negative input of amplifier 218 is connected to ground through resistor 220.

The output of amplifier 218 drives a conventional latch circuit 176 which includes a NOR gate 219 and a NAND gate 220. Latch 176 holds the output of gate 219 high for the period of the y pulse. That is, the output of 219 goes high when the comparator 218 is low and the low x pulse is present. At that time the other input of gate 220 is high due to the high "y" pulse, thus gate 220 goes low, forcing gate 219 to stay high for the duration of the "y" pulse. The comparator 218 output is connected to one input of gate 219 through diode 221 and resistor 222. The other input of gate 219 receives the "x" signal through resistor 223. Gate 220 receives the "y" pulse input and the output of gate 219. The gate 220 output is connected to the gate 219 inputs through diodes 224 and 225.

The output of gate 219 is connected to NAND gate 226 for driving shift register 182 when gate 226 is enabled by closure of switch 180.

The gate 220 output is also connected to the reject rate generator 167, which includes NPN transistors 227 and 228 and an operational amplifier 229. Capacitor 230 in combination with operational amplifier 229 integrates the "y" length pulses from gate 220 occurring at each rejection. NPN transistors 227 and 228 are input controlling for amplifier 229: 227 is a level shifter and 228 assures that ground level is reached when turned off. Resistors 231–235 are various coupling and biasing resistors. Resistor 236 connects the positive input of amplifier 229 to ground. Capacitor 230 is periodically discharged through resistor 237 by "y" pulses that close a CMOS bilateral switch 238. The time constant of resistor 237, capacitor 230 are chosen so that the reject rate "y" width pulses from latch 176 charging capacitor 230 are "corrected" for the product feed rate by partially discharging capacitor 230 by the feed rate "y" pulses at switch 238. In one practical embodiment values of 10 mfd for capacitor 230 and 47.5 kΩ for resistor 237 were used. The resulting voltage at point 239 is substantially proportional to the percentage of product rejections.

In FIG. 10 further details of the alarm circuitry is shown. The pulse interrupt gate 187 includes an FET switch 240 driven by operational amplifier 241 through resistor 242. When switch 240 is closed the pulses from driver 185 via resistor 243 and capacitor 244 that are normally applied at the base of NPN transistor 245 and resistor 246 to ground, are directed to ground. The alarm circuit can be viewed as a missing pulse detector.

When alarm switch 247 is closed, capacitor 248 charges from the positive voltage source through resistor 249. The periodic receipt of reject pulses at the base of transistor 245 discharges capacitor 248 through resistor 250. When capacitor 248 is allowed to charge to a level sufficient to overcome the biasing voltage on transistor 251, the base of which is connected to the collector of transistor 245, the alarm bus goes low and audible and/or visible displays are actuated. The alarm thus occurs either when switch 240 is conducting to divert any incoming reject pulses from driver 185 or when the reject pulses are absent or so infrequent as to allow the charge on capacitor 248 to overcome the bias on transistor 251.

In one practical embodiment of the invention the following component values were used: resistor 249, 1 megaohm; capacitor 248, 50 mfd; resistor 250, 22 ohms; capacitor 244, 10 mfd; and resistor 243, 10 kilohms.

Switch 240 is controlled by the dark and light reject/-rate out of limits detectors 188 and 189. Both are identical except that the detector 189 receives the master light reject rate signals rather than the dark signals.

Detector 188 includes an operational amplifier 252 and feedback stabilizing resistor 253 acting as an error amplifier. The "E" signal from FIG. 8 is applied through resistor 254 to summing junction 255. The "DS" signal is applied through CMOS bilateral switch 256 and resistor 257 to the junction 255. The dark reject switch 180 enables the detector 188. Since the "E" and "DS" signals are of opposite polarity, they are summed at junction 255. Diodes 258 and 259 between detectors 188, 189 and amplifier 241 assure that only a signal indicating a module reject rate exceeding the master reject rate is passed. When the difference is sufficient to exceed the voltage applied to the other input of comparator amplifier 241, the switch 240 is closed.

When amplifier 241 provides an output to close switch 240, it also drives the alarm LED 191 through resistor 260. The amplifier 241 also is driven when capacitor 248 charges due to a lack of reject pulses by means of latching diode 261. Resistor 262 from the junction of diodes 258, 259 and 261 to ground stabilizes amplifier 241.

Various modifications to the disclosed embodiments will be apparent to those of ordinary skill in the art in view of the teachings herein. The scope of the invention is therefore to be limited only by the appended claims.

We claim:

1. In apparatus for sorting articles in which first and second signals are generated in response to light reflected in two separate wavelength spectra, respectively, from said articles as said articles pass one by one along a first predetermined path and in which third and fourth signals are generated in response to light reflected in two separate wavelength spectra, respectively, from further ones of said articles as said further ones pass one by one along a second predetermined path, said first through fourth signals each including a pulsed portion responsive to said light reflected from said articles and a standing light portion responsive to light reflected from sources other than said articles, the combination comprising means for substantially removing the standing light portion of said first through fourth signals to provide fifth through eighth signals, means receiving said fifth and sixth signals for generating a first article reject signal when the ratio of said fifth and sixth signals is more than a predetermined difference from a first predetermined ratio, means receiving said seventh and eighth signals for generating a second article reject signal when the ratio of said seventh and eighth signals is more than a predetermined difference from a controllable ratio, means receiving said first article reject signal for averaging said signal with time, means receiving said second article reject signal for averaging said signal with time, means receiving said averaged first and second article reject signals for generating an error signal proportional to the difference between said averaged first and second article reject signals, and means receiving said error signal for altering said controllable ratio, whereby a servo loop is provided to cause said averaged second article reject signal to follow said first averaged article reject signal.

2. The combination of claim 1 wherein said apparatus comprises master and slave apparatus, said first predetermined path forming a portion of said master apparatus and said second predetermined path forming a portion of said slave apparatus, said servo loop controlled averaged second article reject signal forming a portion of said slave apparatus, whereby said slave apparatus functions to reject articles substantially at the rate of said master apparatus.

3. The combination of claim 1 further comprising means responsive to the feed rate of articles in said second predetermined path for clamping said means for generating an error signal when said feed is interrupted, whereby said means is maintained in a ready condition upon the resumption of the article feed.

4. The combination of claim 1 wherein the apparatus further comprises means receiving said fifth and sixth signals for generating a third article reject signal when the ratio of said fifth and sixth signals is less than a second controllable ratio, means receiving said seventh and eighth signals for generating a fourth article reject signal when the ratio of said seventh and eighth signals is less than a predetermined ratio, means receiving said third article reject signal for averaging said signal with time, means receiving said fourth article reject signal for averaging, said signal with time, means receiving said averaged third and fourth article reject signals for generating a second error signal proportional to the difference between said averaged third and fourth article reject signals, and means receiving said second error signal for altering said second controllable ratio, whereby a second servo loop is provided to cause said averaged fourth article reject signal to follow said third article reject signal.

5. The combination of claim 4 further comprising means selectively receiving said first and third article reject signals for delaying said reject signals to generate a reject control signal for use by an external reject mechanism acting on articles in said first predetermined path and means selectively receiving said second and fourth article reject signals for delaying said reject signals to generate a second reject control signal for use by an external reject mechanism acting on articles in said second predetermined path.

6. The combination of claim 1 further comprising means selectively receiving said first article reject signal for delaying said reject signal to generate a reject control signal for use by an external reject mechanism acting on articles in said first predetermined path.

7. The combination of claim 6 further comprising means selectively receiving said second article reject signal for delaying said second reject signal to generate a second reject control signal for use by an external reject mechanism acting on articles in said second predetermined path.

8. The combination of claim 6 further comprising alarm means receiving said reject control signal for generating an alarm when the rate of reject control signal occurrence is less than a predetermined rate.

9. The combination of claim 8 wherein said alarm means further receives said averaged first and second reject rate signals for generating an alarm when the difference of said signals exceeds a predetermined amount.

10. In apparatus for sorting articles in which first and second signals are generated in response to light reflected in two separate wavelength spectra, respectively, from said articles as said articles pass one by one along a predetermined path, said first and second signals each including a pulsed portion responsive to said light reflected from said articles and a standing light portion responsive to light reflected from sources other than said articles, the combination comprising means for substantially removing the standing light portion of said first and second signals to provide third and fourth signals, and means receiving said third and fourth signals for generating an article reject signal when the ratio of said third and fourth signals is greater than a predetermined ratio, said means receiving said third and fourth signals including adjustable low pass filter means for adjustably narrow band or wide band low pass filtering said signals.

11. In apparatus for sorting articles in which first and second signals are generated in response to light reflected in two separate wavelength spectra, respectively, from said articles as said articles pass one by one along a predetermined path, said first and second signals each including a pulsed portion responsive to said light reflected from said articles and a standing light portion responsive to light reflected from sources other than said articles, the combination comprising means for substantially removing the standing light portion of said first and second signals to provide third and fourth signals, and means receiving said third and fourth signals for generating an article reject signal when the ratio of said third and fourth signals is greater than a predetermined ratio and for generating an article reject signal when the ratio of said third and fourth signals is less than a predetermined ratio, said means receiving said third and fourth signals including adjustable low pass filter means for adjustably narrow band or wide band low pass filtering said signals.

12. In apparatus for sorting articles in which first and second signals are generated in response to light reflected in two separate wavelength spectra respectively, said second signal being generated in response to light reflected in the infrared region, from said articles as said articles pass one by one along a predetermined path, said first and second signals each including a pulsed portion responsive to said light reflected from said articles and a standing light portion responsive to light reflected from sources other than said articles, the combination comprising means for substantially removing the standing light portion of said first and second signals to provide third and fourth signals, and means receiving said third and fourth signals for determining the ratio of said third and fourth signals to generate an article reject signal when the ratio of said third and fourth signals is less than a predetermined ratio, said means including an adjustable low pass filter means for adjustably narrow band or wide band low pass filtering said signals, and means receiving said fourth signal and a fixed level signal for determining the ratio of said fourth and fixed level signals to generate an article reject signal when the ratio of said fourth and fixed level signals is less than a predetermined ratio.

* * * * *